US011497377B2

(12) United States Patent
Liu et al.

(10) Patent No.: US 11,497,377 B2
(45) Date of Patent: Nov. 15, 2022

(54) SEAL FOR DISH WASHER AND DISH WASHER HAVING SAME

(71) Applicants: FOSHAN SHUNDE MIDEA WASHING APPLIANCES MANUFACTURING CO., LTD., Guangdong (CN); MIDEA GROUP CO., LTD., Guangdong (CN)

(72) Inventors: Minyong Liu, Guangdong (CN); Le Tian, Guangdong (CN); Andong Fu, Guangdong (CN); Shoubao Wu, Guangdong (CN); Pingping Xu, Guangdong (CN); Canhua Qiu, Guangdong (CN); Jaekyoo Shin, Guangdong (CN)

(73) Assignees: FOSHAN SHUNDE MIDEA WASHING APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 148 days.

(21) Appl. No.: 16/919,432

(22) Filed: Jul. 2, 2020

(65) Prior Publication Data

US 2020/0329945 A1 Oct. 22, 2020

Related U.S. Application Data

(63) Continuation of application No. PCT/CN2018/116132, filed on Nov. 19, 2018.

(30) Foreign Application Priority Data

Jan. 30, 2018 (CN) ..... 201810090611.8
Jan. 30, 2018 (CN) ..... 201820175493.6

(51) Int. Cl.
*A47L 15/42* (2006.01)
*A47L 15/00* (2006.01)

(52) U.S. Cl.
CPC ..... *A47L 15/4263* (2013.01); *A47L 15/0086* (2013.01)

(58) Field of Classification Search
CPC ..... A47L 15/4263; B60J 10/80–87; E06B 7/22–232; D06F 37/266; F25D 23/028
See application file for complete search history.

(56) References Cited

U.S. PATENT DOCUMENTS 3,458,241 A 7/1969 Barnard et al.
4,827,670 A * 5/1989 Kogiso ..... B60R 13/07 49/476.1

(Continued)

FOREIGN PATENT DOCUMENTS

CA 892149 A 2/1972
CN 201008547 Y 1/2008

(Continued)

OTHER PUBLICATIONS

Extended European Search Report dated Nov. 25, 2020 received in European Patent Application No. 18903469.7.

(Continued)

*Primary Examiner* — Spencer E. Bell
*Assistant Examiner* — Omair Chaudhri
(74) *Attorney, Agent, or Firm* — Scully Scott Murphy & Presser

(57) ABSTRACT

A seal for a dish washer and a dish washer having the seal are provided. The seal has a side seal part, a radial seal part and a mounting part. The side seal part seals a gap between an inner side surface of a water tank of the dish washer and a door body of the dish washer. The radial seal part is connected to the side seal part and seals a gap between an (Continued)

upper surface of the water tank and the door body. The mounting part is connected to at least one of the side seal part and the radial seal part and is mounted to the door body.

8 Claims, 2 Drawing Sheets

(56) References Cited

U.S. PATENT DOCUMENTS

| | | | | |
|---|---|---|---|---|
| 6,334,646 | B1 * | 1/2002 | Oami | B60R 13/07 296/213 |
| 2003/0205255 | A1 * | 11/2003 | DeBoer | A47L 15/4209 134/115 R |
| 2005/0008819 | A1 * | 1/2005 | Kubo | B29C 45/14409 428/122 |
| 2009/0288690 | A1 * | 11/2009 | Haeberle | A47L 15/4263 277/642 |
| 2012/0098393 | A1 * | 4/2012 | Fischer | A47L 15/4263 312/228 |
| 2012/0159858 | A1 * | 6/2012 | Mori | B60J 10/25 49/476.1 |
| 2015/0076856 | A1 * | 3/2015 | Masumoto | B60J 10/277 296/216.06 |
| 2018/0274285 | A1 * | 9/2018 | Haab | E06B 7/2309 |

FOREIGN PATENT DOCUMENTS

| | | | | | |
|---|---|---|---|---|---|
| CN | 106466161 | A | * | 3/2017 | |
| CN | 106466161 | A | | 3/2017 | |
| CN | 206106901 | U | | 4/2017 | |
| CN | 107049197 | A | | 8/2017 | |
| CN | 108209801 | A | | 6/2018 | |
| CN | 108309192 | A | | 7/2018 | |
| DE | 3919773 | A1 | * | 12/1990 | E06B 7/2312 |
| DE | 10 2010 042898 | A1 | | 4/2012 | |
| EP | 0 843 985 | A2 | | 5/1998 | |
| EP | 1790272 | A2 | | 5/2007 | |
| EP | 3216967 | A1 | * | 9/2017 | E06B 7/2309 |
| JP | 09253591 | A | * | 9/1997 | A47L 15/4263 |
| JP | H10-80390 | A | | 3/1998 | |
| JP | 2001-292948 | A | | 10/2001 | |
| JP | 2009-039421 | A | | 2/2009 | |
| JP | 2009039421 | A | * | 2/2009 | A47L 15/4263 |
| JP | 2012217737 | A | * | 11/2012 | A47L 15/4263 |
| WO | 2009/083350 | A1 | | 7/2009 | |

OTHER PUBLICATIONS

International Search Report dated Jan. 30, 2019 received in International Application No. PCT/CN2018/116132 together with an English language translation.

Office Action dated May 24, 2022 received in European Patent Application No. EP 18 903 469.7.

* cited by examiner

SEAL FOR DISH WASHER AND DISH WASHER HAVING SAME

CROSS-REFERENCE TO RELATED APPLICATIONS

The present application is a continuation of PCT International Application No. PCT/CN2018/116132, filed on Nov. 19, 2018, which claims priority to Chinese Patent Application No. 201810090611.8 and Chinese Patent Application No. 201820175493.6, both filed on Jan. 30, 2018, the entire contents of which are incorporated herein by reference for all purposes. No new matter has been introduced.

FIELD

The present disclosure relates to a technical field of household electrical appliances, and more particularly, to a seal for a dish washer and a dish washer having the same.

BACKGROUND

A liner of a sink-type dish washer can be opened by pivoting a door assembly upwardly in order to put tableware in. A clearance fit is employed by a sink-type dish washer in the related art for reducing friction, which makes it convenient to open a door manually by a user.

However, during operation, an arm is rotated and sprays water in the liner when the sink-type dish washer washes the tableware. Thus, it is likely to spray water to the clearance between the door assembly and the liner, which causes the water in the clearance to accumulate at an edge of the liner, and the water is hard to remove.

SUMMARY

The present disclosure solves at least one of the problems existing in the related art. To this end, the present disclosure provides a seal for a dish washer, and the seal for a dish washer achieves satisfactory sealing effect and is easy to mount and dismount.

The present disclosure further provides a dish washer with the above seal.

The seal for a dish washer according to embodiments of the first aspect of the present disclosure includes: a side seal part configured to seal a gap between an inner side surface of a water tank of the dish washer and a door body; a radial seal part connected to the side seal part and configured to seal a gap between an upper surface of the water tank and the door body; and a mounting part connected to at least one of the side seal part and the radial seal part and configured to be mounted to the door body of the dish washer.

The seal for a dish washer according to the embodiments of the present disclosure is good in sealing effect and easy to mount and dismount.

In addition, the seal for a dish washer according to the embodiments of the present disclosure also can have the following additional technical features.

According to an embodiment of the present disclosure, in a cross section of the seal, the side seal part extends from a top to a bottom in an up-down direction.

According to an embodiment of the present disclosure, in the cross section of the seal, the radial seal part extends obliquely upwardly relative to a horizontal direction from an upper edge of the side seal part, and the mounting part is connected to an upper surface of the radial seal part.

Optionally, the seal for a dish washer further includes a seal reinforcing part connected to the side seal part and located between the side seal part and an inner side wall surface of the water tank.

Furthermore, in the cross section of the seal, the seal reinforcing part extends obliquely upwardly relative to the horizontal direction from a lower edge of the side seal part.

According to an optional embodiment of the present disclosure, the seal reinforcing part has a larger inclined angle relative to the horizontal direction in comparison with an inclined angle of the radial seal part relative to the horizontal direction.

According to an embodiment of the present disclosure, the mounting part defines an air cavity therein and is configured to be mounted in a mounting groove of the door body.

Furthermore, the mounting part has an upper wall, the upper wall includes a step part and an arc part, and a lower edge of the arc part is connected to an upper edge of the step part.

According to an embodiment of the present disclosure, the side seal part, the radial seal part, and the mounting part are integrally formed.

The dish washer according to embodiments of the second aspect of the present disclosure includes: a water tank; a door body configured to open and close the water tank; and a seal for a dish washer according to the embodiments of the first aspect of the present disclosure.

With the seal for a dish washer according to the embodiments of the first aspect of the present disclosure, the dish washer according to embodiments of the second aspect of the present disclosure is good in sealing effect and easy to mount and dismount.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of embodiments of the present disclosure will become apparent and more readily appreciated from the following descriptions made with reference to the drawings, in which.

DETAILED DESCRIPTION OF EMBODIMENTS

Figure 1:
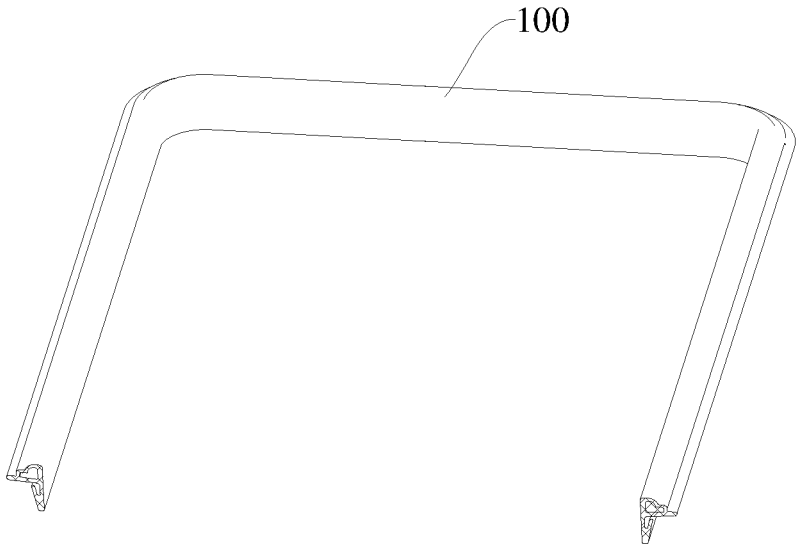
FIG. 1 is a schematic view of a seal for a dish washer according to an embodiment of the present disclosure.

Embodiments of the present disclosure are described in detail, and examples of the embodiments are depicted in the drawings. The same or similar elements and the elements having same or similar functions are denoted by like reference numerals throughout the descriptions. The embodiments described herein with reference to drawings are explanatory and only used to illustrate the present disclosure. The embodiments shall not be construed to limit the present disclosure.

In the description of the present disclosure, it should be understood that, orientation or relation indicated by terms such as "up", "down", "left", "right", "vertical", "horizontal", "top", "bottom" "inner", and "outer", as well as derivative thereof (e.g., "horizontally", "downwardly", "upwardly", etc.) should be construed to refer to the orientation or relation based on the drawings, which are only used for convenience and simplification of description of the present disclosure but do not indicate or imply that the device or element must be particularly orientated or be constructed or operated in a particular orientation, and which cannot be construed to limit the present disclosure. In the description of the present disclosure, the term "a plurality of" means two or more than two, unless specified otherwise.

In the description of the present disclosure, it should be understood that, unless specified or limited otherwise, the terms "mounted," "connected," "coupled," and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

A seal 100 for a dish washer according to an embodiment of the present disclosure is described hereinafter referring to FIG. 1 to FIG. 2.

Figure 2:
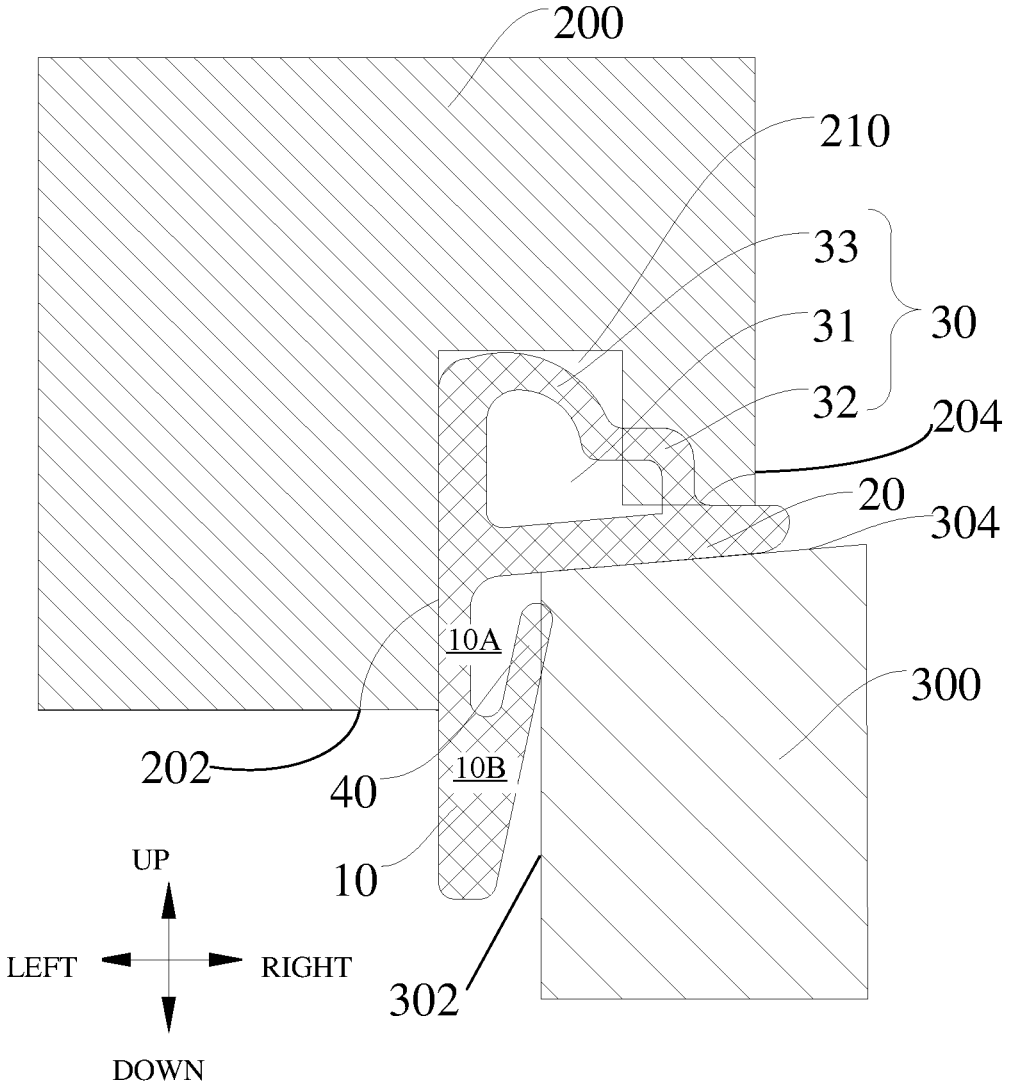
FIG. 2 is a sectional assembly view of the seal when the seal is mounted to a dish washer according to another embodiment of the present disclosure.

As shown in FIG. 1 and FIG. 2, the seal 100 for a dish washer according to an embodiment of the present disclosure includes a side seal part 10, a radial seal part 20 and a mounting part 30.

The side seal part 10 is configured to seal a gap between an inner side surface of a water tank of a dish washer and a door body 200. The radial seal part 20 is connected to the side seal part 10, and the radial seal part 20 is configured to seal a gap between an upper surface of the water tank and the door body 200. The mounting part 30 is connected to at least one of the side seal part 10 and the radial seal part 20, and the mounting part 30 is configured to be mounted to the door body 200 of the dish washer.

For example, the side seal part 10 is located between an inner surface 302 of a side wall 300 of the water tank and a side wall surface 202 of the door body 200, when the door body 200 is closed on the water tank, such that the side seal part 10 can functions as a seal between the inner surface 302 of the side wall 300 of the water tank and the door body 200. The radial seal part 20 is located between an upper surface 304 of the side wall 300 of the water tank and a lower wall surface 204 of the door body 200, such that the radial seal part 20 can functions as a seal between the upper surface 304 of the side wall 300 of the water tank and the lower side wall of the door body 200. The mounting part 30 can be connected to the side seal part 10, the mounting part 30 can also be connected to the radial seal part 20, or the mounting part 30 is connected to both the side seal part 10 and the radial seal part 20 at the same time. The seal 100 for a dish washer is mounted to the door body 200 via the mounting part 30; for example, in the embodiment shown in FIG. 2, the mounting part 30 is connected to the radial seal part 20.

In the seal 100 for a dish washer according to embodiments of the present disclosure, the side seal part 10 is used to seal the inner side surface 302 of the side wall 300 of the water tank and the door body 200, and the radial seal part 20 is used to seal the upper surface 304 of the side wall 300 of the water tank and the door body 200, thereby achieving satisfactory sealing performance between the door body 200 and the side wall 300 of the water tank, effectively preventing water from being spraying to the gap between the door body 200 and the side wall 300 of the water tank when the dish washer is used to wash tableware, and making it easy to clean an edge of a liner. Moreover, the seal 100 is mounted to the door body 200 via the mounting part 30, such that the seal 100 is connected to the door body 200 tightly, separation of the seal 100 from the door body hardly occurs, and mounting and dismounting of the seal 100 are convenient.

Therefore, the seal 100 for a dish washer according to the embodiments of the present disclosure achieves satisfactory sealing effect and is easy to mount and dismount.

The seal 100 for a dish washer according to a specific embodiment of the present disclosure is described hereafter referring to FIG. 1 and FIG. 2.

In some embodiments of the present disclosure, as shown in FIG. 2, in a cross section of the seal, the side seal part 10 extends from a top of the seal 100 to a bottom of the seal 100 in an up-down direction. For example, the side seal part 10 extends from the top to the bottom, a first portion 10A of the side seal part 10 abuts against the side wall surface 202 of the door body 200 and a second portion 10B of the side seal part 10 extends downwards, and in the up-down direction, the lowest point of the side seal part 10 is lower than the lowest point of the side wall of the door body 200, such that the side seal part 10 can provide better sealing effect between the side wall surface 202 of the door body 200 and the inner side surface 302 of the side wall 300 of the water tank.

In an embodiment of the present disclosure, as shown in FIG. 2, in the cross section of the seal 100, the radial seal part 20 extends obliquely or angularly upwardly relative to a horizontal direction (the left and right direction shown in FIG. 2) from an upper edge of the side seal part 10. The mounting part 30 is connected to an upper surface of the radial seal part 20 and adjacent to the side seal part 10. The radial seal part 20 has an inclined angle relative to the horizontal direction, and the upper surface 304 of the side wall 300 of the water tank has the same inclined angle relative to the horizontal direction. Thus, the radial seal part 20 abuts against the upper surface 304 of the side wall 300 of the water tank, such that the radial seal part 20 provides satisfactory sealing effect between a lower wall surface 204 of the door body 200 and an upper wall surface 304 of the water tank. A surface of the mounting part 30 adjacent to the side wall of the door body 200 can be parallel to a surface of the side seal part 10 adjacent to the door body 200.

According to an embodiment of the present disclosure, as shown in FIG. 2, the seal 100 for a dish washer further includes a seal reinforcing part 40. The seal reinforcing part 40 is connected to the side seal part 10, and is located between the side seal part 10 and the inner side surface 302 of the side wall 300 of the water tank. Therefore, the seal reinforcing part 40 can further seal the door body 200 and an inner side wall surface 302 of the water tank and provide satisfactory sealing effect.

Optionally, referring to the embodiment shown in FIG. 2 again, in the cross section of the seal 100, the seal reinforcing part 40 extends obliquely or angularly upwardly relative to the horizontal direction from a lower edge of the side seal part 10. In the up-down direction, the highest point (i.e., the upper terminal end) of the seal reinforcing part 40 is higher than the lowest point of the side wall of the door body 200, and an upper edge of the seal reinforcing part 40 resiliently abuts against the inner side wall surface 302 of the water tank substantially in the horizontal direction, such that the seal reinforcing part 40 provides satisfactory sealing between the water tank and the door body 200. Moreover, the seal reinforcing part 40 can functions as a buffer because of its own elasticity when the door body 200 is closed.

Furthermore, as shown in FIG. 2, the seal reinforcing part 40 has a larger inclined angle relative to the horizontal direction in comparison with the inclined angle of the radial seal part 20 relative to the horizontal direction.

According to an embodiment of the present disclosure, as shown in FIG. 2, the mounting part 30 defines an air cavity 31 therein and is configured to be mounted in a mounting groove 210 of the door body 200. In the cross section of the seal, the mounting groove 210 of the door body 200 has a downward opening, the air cavity 31 and its surrounding structure are received in the mounting groove 210. When the door body 200 is closed, the air cavity 31 can buffer the door body 200, and the seal 100 can be mounted to the door body 200 via the air cavity 31 with a good mounting effect, and separation of the seal 100 from the door body 200 hardly occurs.

Optionally, referring to the embodiment shown in FIG. 2, the mounting part 30 has an upper wall, and the upper wall includes a step part 32 and an arc part 33, a lower edge of the arc part 33 is connected to an upper edge of the step part 32. In the cross section of the seal 100, a lower edge of the step part 32 is connected to the upper surface of the radial seal part 20, and the arc part 33 is located at a side of the step part 32 adjacent to the side wall of the door body 200 in the horizontal direction, such that the mounting part 30 is mounted to the door body 200 with its own elasticity, achieving a satisfactory mounting effect and closer connection.

According to an embodiment of the present disclosure, the side seal part 10, the radial seal part 20, and the mounting part 30 are integrally formed. Therefore, the seal 100 for a dish washer is convenient to manufacture and good in integral structural stability.

A dish washer according to an embodiment of the present disclosure is described hereafter.

The dish washer according to the embodiment of the present disclosure includes a water tank, the door body 200 configured to open and close the water tank, and the seal 100 for a dish washer according to an embodiment of the present disclosure.

With the seal 100 for a dish washer according to an embodiment of the present disclosure, the dish washer according to an embodiment of the present disclosure is good in sealing effect and convenient to mount and dismount.

Other configurations and operations of the seal 100 for a dish washer according the embodiments of the present disclosure are known to one of ordinary skill in the art and will not described in detail herein.

Reference throughout this specification to terms "an embodiment," "some embodiments," "exemplary embodiment", "an example," "a specific example," or "some examples," means that a particular feature, structure, material, or characteristic described in connection with the embodiment or example is included in at least one embodiment or example of the present disclosure. Thus, the appearances of the terms throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that changes, modifications, alternatives and variants can be made in the embodiments without departing from principles and purpose of the present disclosure. The scope of the present disclosure is defined by claims and equivalents thereof.

What is claimed is:

1. A dish washer comprising:

a water tank;

a door body configured to open and close the water tank; and a seal mounted in a mounting groove of the door body, the seal comprising:

a side seal part configured to seal a gap between an inner side surface of the water tank and a side wall surface of the door body, the side wall surface extending from the mounting groove to a bottom surface of the door body, wherein, in a cross section of the seal:

the side seal part extends along a first axis and comprises a first portion and a second portion;

the first portion is configured to engage against the side wall surface of the door body when the seal is mounted in the mounting groove of the door body; and the second portion is configured to extend from the first portion along the first axis beyond the bottom surface of the door body when the seal is mounted in the mounting groove of the door body;

a radial seal part connected to the side seal part and configured to seal a gap between an upper surface of the water tank and the door body, the radial seal part extending from the first portion of the side seal part along a second axis that is oblique to the first axis and at an obtuse angle to the second portion of the side seal part; and a mounting part connected to at least one of the side seal part and the radial seal part and configured to engage against a wall of the mounting groove of the door body of the dish washer to mount the seal in the mounting groove, wherein the side seal part comprises a seal reinforcing part extending toward the radial seal part along a third axis that is oblique to the first axis and at an acute angle to the second portion of the side seal part, the seal reinforcing part being configured to engage against the inner side surface of the water tank.

2. The dish washer according to claim 1, wherein in the cross section of the seal, the side seal part extends from a top of the seal to a bottom of the seal in an up-down direction.

3. The dish washer according to claim 2, wherein in the cross section of the seal, the radial seal part extends obliquely upwardly relative to a horizontal direction from an upper edge of the side seal part, and the mounting part is connected to an upper surface of the radial seal part.

4. The dish washer according to claim 1, wherein in the cross section of the seal, the seal reinforcing part extends obliquely upwardly relative to the horizontal direction from a lower edge of the side seal part.

5. The dish washer according to claim 4, wherein the seal reinforcing part has an inclined angle relative to the horizontal direction and the radial seal part has an inclined angle relative to the horizontal direction, the inclined angle of the seal reinforcing part being larger than the inclined angle of the radial seal part.

6. The dish washer according to claim 1, wherein the mounting part defines an air cavity therein and is configured to be mounted in the mounting groove of the door body.

7. The dish washer according to claim 6, wherein:

the mounting part has an upper wall, the upper wall comprises a step part and an arc part, and a lower edge of the arc part is connected to an upper edge of the step part.

8. The dish washer according to claim 1, wherein the side seal part, the radial seal part, and the mounting part are integrally formed.

* * * * *